US006664997B2

(12) United States Patent
Shimizu et al.

(10) Patent No.: US 6,664,997 B2
(45) Date of Patent: Dec. 16, 2003

(54) METHOD OF DRIVING FLUORESCENT PRINT HEAD AND IMAGE FORMING APPARATUS

(75) Inventors: Yukihiko Shimizu, Mobara (JP); Satoshi Yamaguchi, Mobara (JP); Yoichi Kobori, Mobara (JP); Masao Saito, Mobara (JP); Kinya Ueda, Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 10/115,975

(22) Filed: Apr. 5, 2002

(65) Prior Publication Data

US 2002/0186295 A1 Dec. 12, 2002

(51) Int. Cl.[7] ..... H01J 1/62

(52) U.S. Cl. ..... 347/237; 347/247; 313/496; 313/497; 315/169.1; 315/169.3

(58) Field of Search ..... 347/237, 247; 313/496, 497; 315/169.3, 169.1

(56) References Cited

U.S. PATENT DOCUMENTS 6,340,865 B2 * 1/2002 Kawasaki et al. ..... 315/169.1

6,522,062 B2 * 2/2003 Ogawa et al. ..... 313/496

* cited by examiner

*Primary Examiner*—Huan H. Tran

(74) *Attorney, Agent, or Firm*—Oblon, Spivak, McClelland, Maier & Neustadt, P.C.

(57) ABSTRACT

A fluorescent print head driving method is provided wherein an operational lifetime is improved by reducing the evaporation amount of Ba contained in an electron emitter material of a filament cathode and suppressing the deterioration of the luminous efficiency. In the pre-luminous period T1 during which luminous dots glow before forming an image on a recording medium, a grid voltage is controlled to be a predetermined voltage of a rated value or less and a filament voltage is controlled to a predetermined voltage of a rated value or less. In the print luminous period T2 during which luminous dots glow before forming an image on a recording medium, a grid voltage blank period is created corresponding to a luminous blank period between glow states during which an anode voltage is written for one line on the recording medium. The anode voltage and the grid voltage are controlled to be a rated voltage with a duty ratio corresponding to a blank period. Thus, the filament voltage is controlled to be a predetermined voltage of a rated value or less.

11 Claims, 8 Drawing Sheets

METHOD OF DRIVING FLUORESCENT PRINT HEAD AND IMAGE FORMING APPARATUS

BACKGROUND OF THE INVENTION

The present invention relates to a method of driving a fluorescent print head used as a light source for an optical printer (an image forming apparatus) such as a color printer, which forms an image on a recording medium such as a photosensitive film (e.g. an instant film) or a photographic paper (e. g. a silver salt paper), and to an image forming apparatus.

A fluorescent print head mounted on an optical printer such as a color printer, which uses light emitted due to electrons hitting a fluorescent substance and creates a desired image on a recording medium (e.g. a photosensitive film and a photographic paper), is well known.

FIG. 3 is a cross-sectional view partially illustrating a fluorescent print head of the above-mentioned type. FIG. 4 is a plan view illustrating luminous dots of a fluorescent print head. FIG. 5(*a*) is a perspective view partially illustrating the anode substrate of a fluorescent print head. FIG. 5(*b*) is a plan view partially illustrating the anode portion. FIG. 6 is a side view illustrating an optical printer having three fluorescent print heads for R (red), G (green) and B (blue) luminous colors.

As shown in FIG. 6, the optical printer 1 has as a dot array three fluorescent print heads 2 (2R, 2G, 2B). Each fluorescent print head 2 has luminous dots emitting R (red), G (green) or B (blue) color (or a R, G, or B filter is combined with a luminous dot of a fluorescent substance with a broad wavelength (e.g. a ZnO:Zn fluorescent substance) containing R, G and B components). A recording medium such as a film is exposed to the light beams from respective print heads 2 to form a desired image.

The three fluorescent print heads 2R, 2G, and 2B have the same structure (However, the combination of either fluorescent substances or fluorescent substances and R, G, and B filters is different). Here, the structure of a fluorescent print head 2R emitting red color light will be described below as an example.

As shown in FIG. 3, the fluorescent print head 2R has a container 6, being a box assembled with an anode substrate 3, side plates 4, and a rear substrate 5 by bonding together with a sealing glass. The inside of the container 6 is evacuated in a vacuum state.

As shown in FIG. 4, a first luminous dot column 8 of plural luminous dots 7 and a second luminous dot column 9 of plural luminous dots 7 are arranged in parallel along the longitudinal direction of the anode substrate 3 over the inner surface of the anode substrate 8. Each luminous dot 7 has an anode electrode 10 (made of a frame-like conductive thin film of aluminum), patterned on the anode substrate 10 using the sputtering and the photolithography, and a fluorescent substance layer 11 coated on the anode 10.

The fluorescent substance layer 11, for example, made of zinc oxide fluorescent substance (ZnO:Zn), or cadmium sulfide series fluorescent substance ((Zn,Cd)S:Ag,Cl), is formed in such a way that the layer 11 has an opening wider than the square opening 10*a* of the anode 10 and does not run off the frame. The light emitted from the surface of the fluorescent substance layer 11 radiated outside through the fluorescent substance and the anode substrate 3 from the opening of the anode 10. Hence, the area of each luminous dot 7 corresponds to the effective luminous area of the fluorescent substance layer 11 defined by the opening 10*a* of the anode 10.

In the first and second luminous dot columns 8 and 9, respective luminous dots 7 are led out with the anode conductor 12 and are electrically connected to the control circuit 14 on the circuit substrate 13, using, for example, TAB (tap-automated bonding, as shown in FIGS. 3 and 6.

Here, the shape of each luminous dot 7 and the arrangement of the first and second luminous dot columns 8 and 9 will be described. As shown in FIG. 4, each luminous dot 7 is in a square form of which one side has a length (a). In the first and second luminous dot columns 8 and 9, a large number of luminous dots 7 are arranged at intervals of (a) in the primary scanning direction. The luminous dots in the luminous dot column 8 and the luminous dots in the luminous dot column 9 are shifted to each other by the pitch P (=a) in the scanning direction. Moreover, the luminous dots in the luminous dot column 8 and the luminous dots in the luminous dot column 9 are spaced away from each other by the pitch (b) (an integer multiple of the pitch P in the primary scanning direction) in the secondary scanning direction. The luminous dot columns 8 and 9 also are arranged in parallel and in zigzag form.

As shown in FIG. 3, a flat control electrode 15 is arranged as a control electrode on the upper surface of the anode substrate 3. The flat control electrode 15, which is made of a conductive film (e.g. aluminum), surrounds the luminous dots 7 and anode conductors 12 and is disposed so as to be flush with the luminous dots 7. A positive voltage is always applied to the flat control electrode 15 upon drive operation to maintain the adjacent electric field at a fixed level.

In the container 6, as shown in FIG. 3, the first filament cathode 16 and the second filament cathode 17, each being a thermionic cathode, are suspended above the first and second luminous dot columns 8 and 9. The first filament cathode 16 and the second filament cathode 17 are arranged in the primary scanning direction and are spaced substantially at equal distances from the centers of the luminous dot columns 8 and 9. In the filament cathodes 16 and 17, an electron emission material is coated on an ultra-fine tungsten alloy wire (e.g. tungsten or rhenium tungsten) of a diameter of 7 $\mu$m to 50 $\mu$m. The electron emission material is made of a ternary oxide containing barium oxide, calcium oxide, and strontium oxide. That oxide is uniformly coated at a thickness of 5 $\mu$m to 10 $\mu$m over a tungsten of a diameter of several $\mu$m to several tens $\mu$m. The filament voltage is adjusted to set the filament cathodes 16 and 17 to 600° C. to 700° C. Thus each of the filament cathodes 16 and 17 functions as a thermal electron source.

A NESA film 18*a*, being an anti-static translucent conductive film, is formed on the inner surface of the rear substrate 5. A anti-reflection layer 18*b* formed of graphite is formed on the NESA film 18*a*. The anti-static layer 18*b* absorbs light from the luminous dot 7 (anode 10) to prevent it from being reflected back to the luminous dot 7. With omission of the anti-static layer 18*b*, the light reflected back to the light emission side leaks from the gap between the anode 10 and the flat control electrode 15. This decreases the display contrast.

Inside the enclosure 6 shown in FIG. 3, a first shield electrode 19 of a stainless steel thin plate is disposed outside the luminous dot column 8 and the first filament cathode 16. Similarly, the second shield electrode 20 of a stainless steel thin plate is disposed outside the luminous dot column 9 and the second filament cathode 17. The shield electrodes 19 and 20 are connected together to the same potential. Each of the shield electrodes 19 and 20 is a plate having a nearly L-shaped cross section, viewed from the plane perpendicular to the primary scanning direction. The flange plates are disposed in parallel on the surface of the anode substrate 3. The shield electrode 19 or 20 may be a flat plate. The flange plate of each of the shield electrode 19, 20 is disposed above the anode substrate 3 via the insulating layer 21 containing main components (e.g. a low-melting point glass) (or with the gap of about 0.5 mm or less). The shield electrodes 19 and 20 surround the filament cathodes 16 and 17 and the upper ends thereof are positioned above the filament cathodes 16 and 17. The shield electrode 19, 20 prevents the surface of the insulating layer 21 from being charged up. The shield electrode 19, 20 covers the anode conductor 12 for the luminous dot 7 and the conductor for the flat control electrode 15 to reduce the reactive current. Moreover, the reactive current passing the flat control electrode 15 and luminous dots 7 can be reduce by restricting the aperture of the opening defined by the shied electrodes 19 and 20.

In three fluorescent print heads 2R, 2G and 2B shown in FIG. 6, the luminous dot columns 8 and 9 are arranged in parallel and at predetermined intervals. The longer side of the anode substrate 3 corresponds to a horizontal direction (in the vertical orientation with respect to the paper surface) and the shorter side of the anode substrate 3 corresponds to a vertical direction (in the upper orientation of the paper surface). In the fluorescent print heads 2R, 2G and 2B, the dot-like light beam emitted from each luminous dots 7 passes through the translucent anode substrate 3 and irradiates horizontally and forward (in the right orientation on this paper). In each fluorescent print head 2R, 2G, 2B, an imaging optical system 24 formed of a prism (or a reflecting mirror) 22 and a Selfoc lens array (an equi-magnification imaging lens array) 23 is mounted on the front side of the anode substrate 3.

The imaging optical system 24 forms an erect equi-magnification image. The opening 10*a* of an anode 10 in the fluorescent print head 2 acts as a focal point. The photosensitive surface of the film 25 (a recording medium) acts as a projected image point 23. The imaging optical system 24 bends at a right angle the optical path of the dot-like light beam irradiated from the fluorescent print head 2 to the front side of the anode substrate 3 and guides it vertically and downward. As to the relationship between the luminous dot 7 and the photosensitive surface of the film 25 (a recording medium) in horizontal state, the longer side of the anode substrate 3 corresponds to a horizontal direction (the vertical orientation of this paper and the direction perpendicular to the shorter side of the anode substrate 3 corresponds to a vertical direction (the right orientation of this paper).

As shown in FIG. 6, the red filter R, the green filter G and the blue filter B are disposed under the Selfoc lens arrays 23, respectively. The filters R, G and B confront the film 25 so as to be spaced away from it a predetermined distance.

The three fluorescent print heads with the above-mentioned structure are mounted and modulalized as one container 27, together with the drive circuit 26. The drive circuit 26 includes the control circuit 14, mounted on the circuit substrate 13, for controlling the drive operation of various electrodes (such as anodes 10, flat control electrodes and filament cathodes 16 and 17) and the power source circuit 33.

In the recording operation of the optical printer 1 with the above-mentioned structure, the film 25 is relatively moved in the secondary direction with respect to light beams emitted from the fluorescent print heads 2R, 2G and 2B, as shown in FIG. 6. Image data decomposed into R, G and B colors are respectively sent to the corresponding fluorescent print heads 2R, 2G and 2B. The luminous dots columns 8 and 9 of each fluorescent print head 2 glow with a predetermined timing in sync with the relative movement.

In this drive operation of each fluorescent print head 2, the luminous dots 7, which is arranged in zigzag form in the luminous dot columns 8 and 9, continuously emit light beams onto the film 25 in parallel to the primary direction and in a straight line. Each fluorescent print head 2 repeatedly irradiates light beams onto the film 25 to create a desired full-color image.

However, in the optical printer 1 provided with the conventional fluorescent print heads 2 each configured of a fluorescent luminous tube, the problem is that the light amount decreases as the fluorescent luminous tube is driven and lit for a long period of time on the occasion of printing.

A decrease in light amount of the fluorescent luminous tube causes a lack of the density necessary for a recording medium (or a photographic paper). As a result, the print image quality is deteriorated.

The light amount of a fluorescent luminous tube depends on the magnitude (input: voltage×current) of a flow of electrons exciting a fluorescent substance, a luminous time period, and the luminous efficiency of a fluorescent substance. The fluorescent substance itself does not substantially change its property because the accelerating voltage is low (20 to 70 volts, 30 to 40 volts on average).

In the fluorescent print head 2, as shown in FIG. 3, filament cathodes 16 and 17 heated at high temperatures (about 700° C.) are suspended above the fluorescent substances. The electron emission material formed of a ternary carbonate, particularly, barium (Ba) coated on the surface of the filament cathode 16, 17 is gradually evaporated during a long period of time and thus adheres to and contaminates the surface of the fluorescent substance layer 11. For tat reason, the contaminant adhered to the surface of the fluorescent substance layer 11 limits the accelerated electrons emitted from the filament cathode 16, 17 and blocks the light emission of the fluorescent semiconductor layer 11, thus decreasing the light amount.

Evaporation of the electron emission material of the filament cathode 16, 17 deteriorates the electron emission capability and decreases the electron flow, thus decreasing the light amount.

As described above, a decrease of the light amount (an initial light amount=brightness×time) mainly is caused by the evaporation of the electron emission material (mainly Ba) of the filament cathodes 16, 17. The evaporation rate is controlled by the operational temperature of the filament cathode 16, 17. That is, as shown in FIG. 8, increasing the operational temperature of the filament cathode 16, 17 leads to a high rate of evaporation, thus accelerating a decrease in light amount. On the other hand, decreasing the operational temperature of the filament cathode 16, 17 leads to a low rate of evaporation, thus delaying a decrease in light amount.

As shown in FIG. 9, lowering the operational temperature of the filament cathode 16, 17 prolongs the operational lifetime. However, as shown in FIG. 10, excessively lowering the temperatures results in the electron emission amount (emission current) of the filament cathode 16, 17. Under the same drive conditions, the filament cathode 16, 17 moves to the temperature restriction region (the region depending on the temperature of the filament cathode 16, 17 itself) shown in FIG. 10 (vacuum tube characteristics of a thermionic cathode in case of the filament 5MG). This decreases the light amount, thus resulting in unstable light emission.

Generally, in the fluorescent print head 2 built in an image forming apparatus such as an optical printer, some output images have the spot being in luminous state at all times or the spot being in non-luminous state at all times. Particularly, the spot in non-luminous state varies its light amount because gases remaining inside the container 6 adhere to the surface of the fluorescent substance layer 11. When the light amount varies, the light amount of the luminous dot 7 previously being in non-luminous state varies at the time of outputting a different image. As a result, the density of an output image varies partially.

For that reason, conventionally, when the optical printer 1 having the fluorescent print head 2 prints an image, a variation in light amount of the non-luminous portion is alleviated. Hence, a previous light emitting operation (hereinafter, referred to as pre-light emission) is performed by light-emitting all dots, for example, for several minutes before the print operation. After stabilization of the light emission, an image printing operation is performed. In this case, the pre-light emission is preliminary light emission performed in advance to stabilize the luminous condition.

In further explanation, in the conventional structure, as shown in FIG. 7, the filament cathode 16, 17 is heated and driven at 600° C. to 700° C. immediately before the pre-luminous period T1. During the pre-luminous period T1, the anode voltage and the grid voltage are driven under the rated conditions (the rated condition means the same drive condition (voltage) as that in the print luminous period T2). Until the print luminous period T2 ends, the filament cathodes 16 and 17 are heated and driven while the anode voltage and the grid voltage are driven under rating conditions.

However, in the conventional pre-light emission operation, because the luminous time period not contributing to printing is added, the operational lifetime of the fluorescent print head is fastened.

SUMMARY OF THE INVENTION

The present invention is made to solve the above-mentioned problems.

An object of the invention is to provide a fluorescent print head driving method capable of improving an operational lifetime. In this method, a filament voltage is decreased during a luminous dot glowing period except a printing period, thus decreasing the evaporation amount of Ba contained in an electron emitter material for a filament cathode heated and driven, so that deterioration of the luminous efficiency is suppressed.

Another object of the invention is to provide an image forming apparatus capable of improving an operational lifetime.

In order to achieve the above-mentioned objects, an aspect of the present invention is characterized by a method of driving a fluorescent print head, the fluorescent print head having a filament cathode, a control electrode for controlling electrons emitted from the filament cathode, a fluorescent substance layer having a plurality of luminous dots each which emits light when electrons emitted from the filament cathode impinges against the fluorescent substance layer, and an anode on which the fluorescent substance layer is coated. Moreover, a pre-luminous period during which the luminous dots glow before an image is formed on a recording medium and a print luminous period during which the luminous dots glow to create an image on the recording medium are provided. The method comprises the steps of, during the pre-luminous period, controlling at least one of an anode voltage to be applied to the anode and a grid voltage to be applied to the control electrode, to a rated voltage or less in a print luminous mode; and controlling a filament voltage to be applied to the filament cathode to a rated voltage or less in a print luminous mode.

Another aspect of the present invention is characterized by a method of driving a fluorescent print head, the fluorescent print head having a filament cathode, a control electrode for controlling electrons emitted from the filament cathode, a fluorescent substance layer having a plurality of luminous dots each which emits light when electrons emitted from the filament cathode impinges against the fluorescent substance layer, and an anode on which the fluorescent substance layer is coated. Moreover, a pre-luminous period during which the luminous dots glow before an image is formed on a recording medium and a print luminous period during which the luminous dots glow to create an image on the recording medium are provided. The method comprises the steps of, during the pre-luminous period, controlling an anode voltage to be applied to the anode or a grid voltage to be applied to the control electrode, with a predetermined duty ratio; and controlling a filament voltage to be applied to the filament cathode to a rated voltage or less in a print luminous mode.

Another aspect of the invention is characterized by a method of driving a fluorescent print head, the fluorescent print head having a filament cathode, a control electrode for controlling electrons emitted from the filament cathode, a fluorescent substance layer having a plurality of luminous dots each which emits light when electrons emitted from the filament cathode impinges against the fluorescent substance layer, and an anode on which the fluorescent substance layer is coated. Moreover, a pre-luminous period during which the luminous dots glow before an image is formed on a recording medium and a print luminous period during which the luminous dots glow to create an image on the recording medium are provided. The method comprises the steps of controlling an anode voltage to be applied to the anode or a grid voltage to be applied to the control electrode, to a rated voltage or less in a print luminous mode; controlling the anode voltage or the grid voltage with a predetermined duty ratio; and controlling a filament voltage applied to the filament cathode to a rated voltage or less in a print luminous mode.

Another aspect of the invention is characterized by a method of driving a fluorescent print head, the fluorescent print head having a filament cathode, a control electrode for controlling electrons emitted from the filament cathode, a fluorescent substance layer having a plurality of luminous dots each which emits light when electrons emitted from the filament cathode impinges against the fluorescent substance layer, and an anode on which the fluorescent substance layer is coated. Moreover, a blank period of a grid voltage applied to the control electrode corresponding to the blank period between glow states during which an anode voltage to be applied to the anode is written for each line of a recording medium is provided. The method comprises the steps of, during a print luminous period for which said luminous dots glow when an image is created on the recording medium, controlling the anode voltage and the grid voltage, to a rated voltage in a print luminous mode with a duty ratio corresponding to the blank period; and controlling a filament voltage to be applied to the filament cathode to a rated voltage or less in a print luminous mode.

The method according to the invention further comprises the steps of providing a blank period of the grid voltage corresponding to a blank period between glow states during which an anode voltage to be applied to the anode is written for each line of the recording medium; during a print luminous period for which the luminous dots glow when an image is created on the recording medium, controlling the anode voltage and the grid voltage to a rated voltage in a print luminous mode with a duty ratio corresponding to the blank period; and controlling the filament voltage to a rated voltage or less in a print luminous mode.

Another aspect of the invention is characterized by a method of driving a fluorescent print head, the fluorescent print head having a filament cathode, a fluorescent substance layer having a plurality of luminous dots each which emits light when electrons emitted from the filament cathode impinges against the fluorescent substance layer, and an anode on which the fluorescent substance layer is coated. Moreover, a pre-luminous period during which the luminous dots glow before an image is formed on a recording medium and a print luminous period during which the luminous dots glow to create an image on the recording medium are provided. The method comprises the steps of controlling an anode voltage to be applied to the anode to a rated voltage or less in a print luminous mode; and controlling a filament voltage to be applied to the filament cathode to a rated voltage or less in a print luminous mode.

Another aspect of the invention is characterized by a method of driving a fluorescent print head, the fluorescent print head having a filament cathode, a fluorescent substance layer having a plurality of luminous dots each which emits light when electrons emitted from the filament cathode impinges against the fluorescent substance layer, and an anode on which the fluorescent substance layer is coated. Moreover, a pre-luminous period during which the luminous dots glow before an image is formed on a recording medium and a print luminous period during which the luminous dots glow to create an image on the recording medium are provided. The method comprises the steps of controlling an anode voltage to be applied to the anode with a predetermined duty ratio; and controlling a filament voltage to be applied to the filament cathode to a rated voltage or less in a print luminous mode.

According to further another aspect of the invention, an image forming apparatus comprises a fluorescent print head having a filament cathode, a fluorescent substance layer having a plurality of luminous dots each emitting light when electrons emitted from the filament cathode impinges against the fluorescent substance layer, and an anode on which the fluorescent substance layer is coated; a controller for acquiring and outputting pre-luminous pattern data based on a pre-luminous signal and a voltage switching signal and acquiring and outputting image data and a voltage switching signal based on a print starting signal; a voltage selector for selecting the filament cathode drive voltage and the anode drive voltage to the fluorescent print head based on a voltage switching signal input from the controller; and a driver for driving and emitting the luminous dots of the fluorescent print head based on pre-luminous pattern data or image data input from the controller; whereby the luminous dots of the fluorescent print head are previously emitted based on a drive voltage input from the voltage selector and pre-luminous pattern data input from the voltage selector; whereby the luminous dots of the fluorescent print head are emitted based on a drive voltage input from the voltage selector and image data input from the driver and a desired image is created by illuminating light from the luminous dots onto a recording medium.

The apparatus further comprises a control electrode for controlling electrons emitted from the filament cathode. The voltage selector selects a drive voltage for the filament cathode, a drive voltage for the anode and a drive voltage for the control electrode of the fluorescent print head based on a voltage switching signal input from the controller.

In the apparatus according to the present invention, the voltage selector comprises plural power sources each for producing a different drive voltage and a selector circuit for selecting a power source which produces a drive voltage corresponding to a voltage switching signal input from the controller.

In the apparatus according to the present invention, the controller acquires and outputs pre-luminous drive data based on a pre-luminous signal and print drive data based on a print starting signal. The voltage selector includes a variable power source for variably producing a different drive voltage corresponding to a voltage switching signal input from the controller.

BRIEF DESCRIPTION OF THE DRAWINGS

This and other objects, features, and advantages of the present invention will become more apparent upon a reading of the following detailed description and drawings, in which.

DETAILED DESCRIPTION OF THE PREFERRED EMBODIMENT

Figure 1:
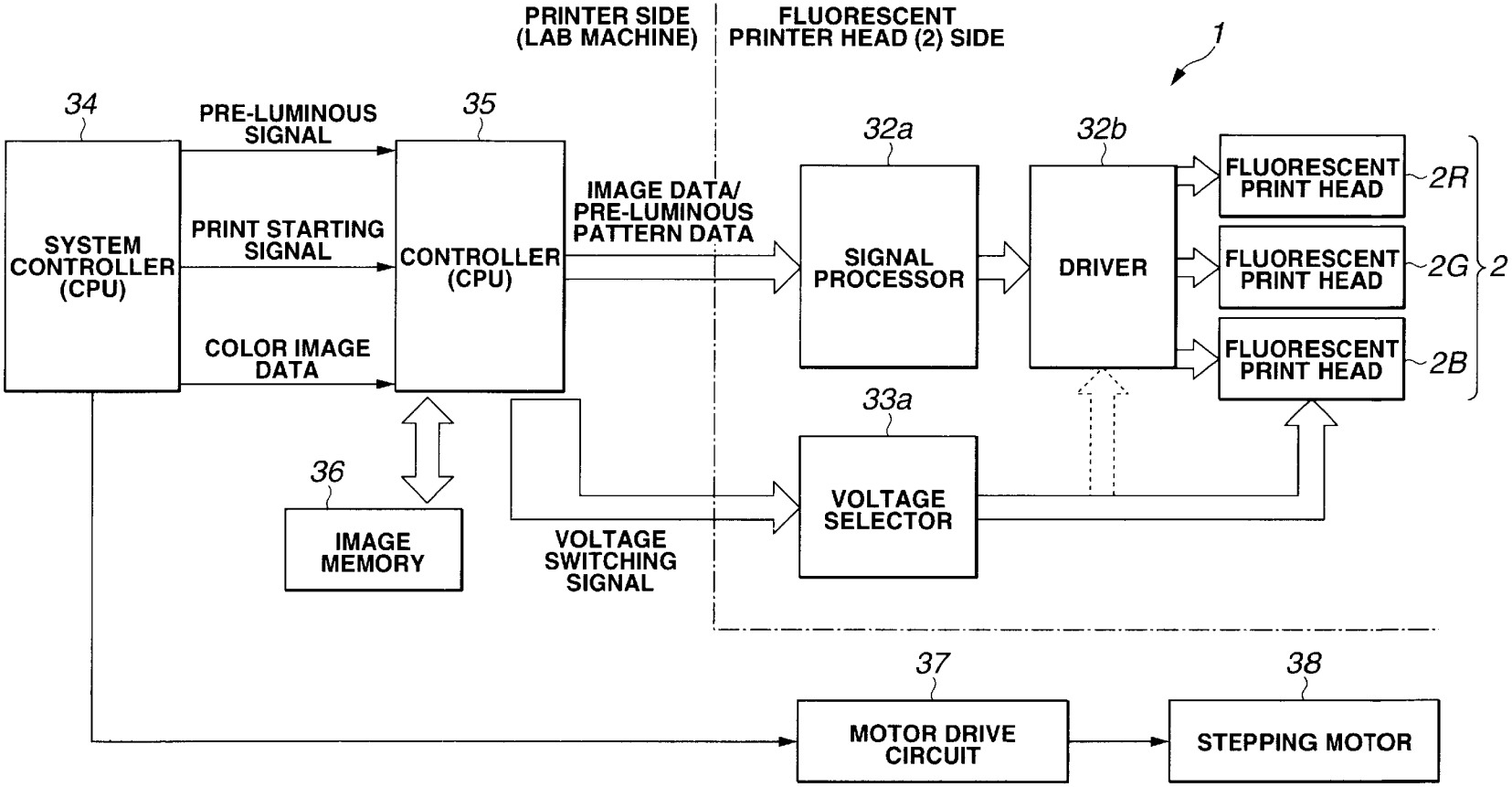
FIG. 1 is a block diagram illustrating an image forming apparatus according to the present invention.
Figures 2A, 2B, 2C, 2D, 2E:
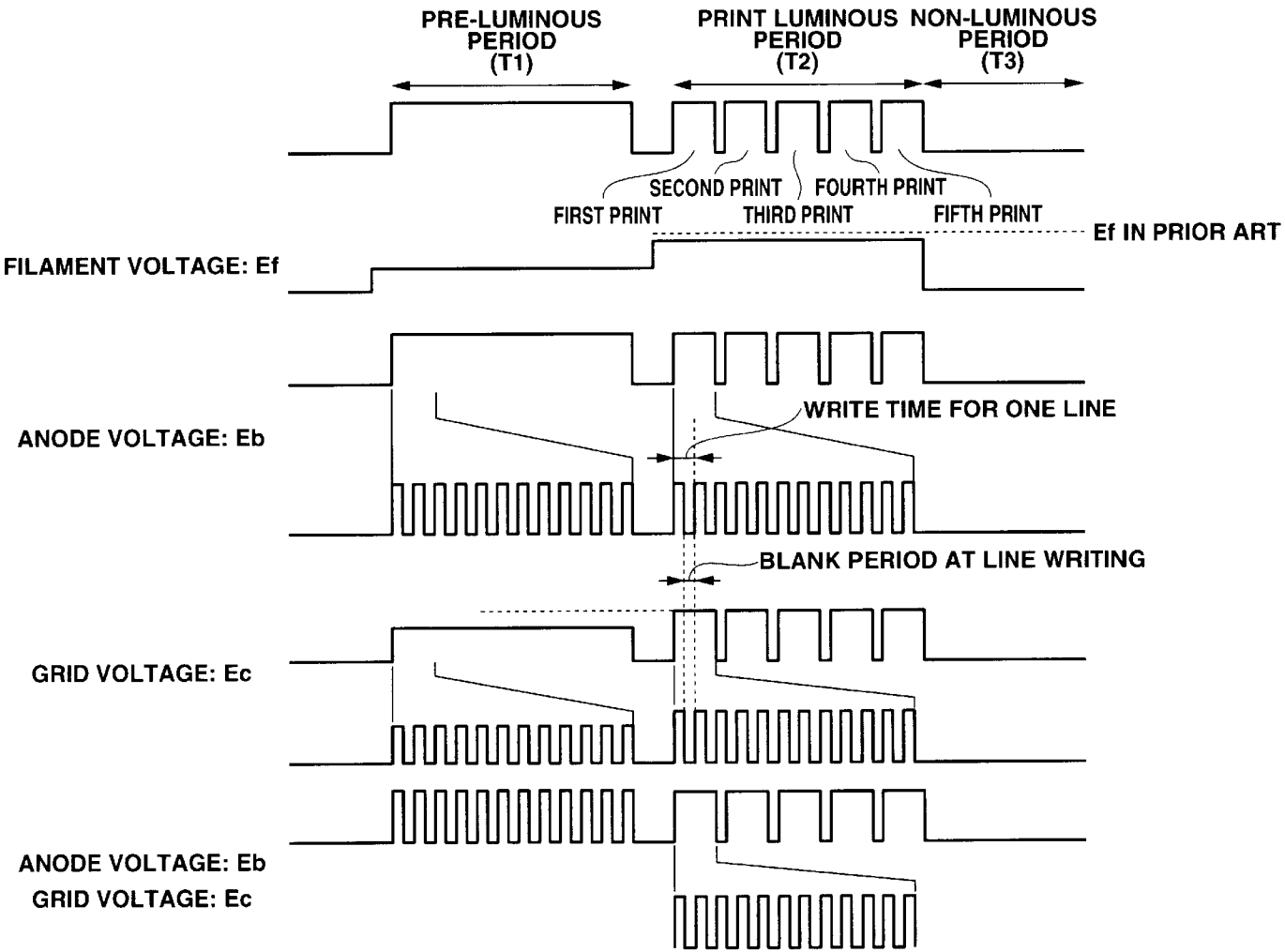
FIG. 2 illustrates a timing chart of an image forming apparatus according to the present invention.

FIG. 1 is a block diagram illustrating the configuration of an image forming apparatus according to an embodiment of the present invention. FIGS. 2(*a*) to 2(*e*) are timing charts each for the drive circuit of a fluorescent print head in an image forming apparatus.

Figure 3:
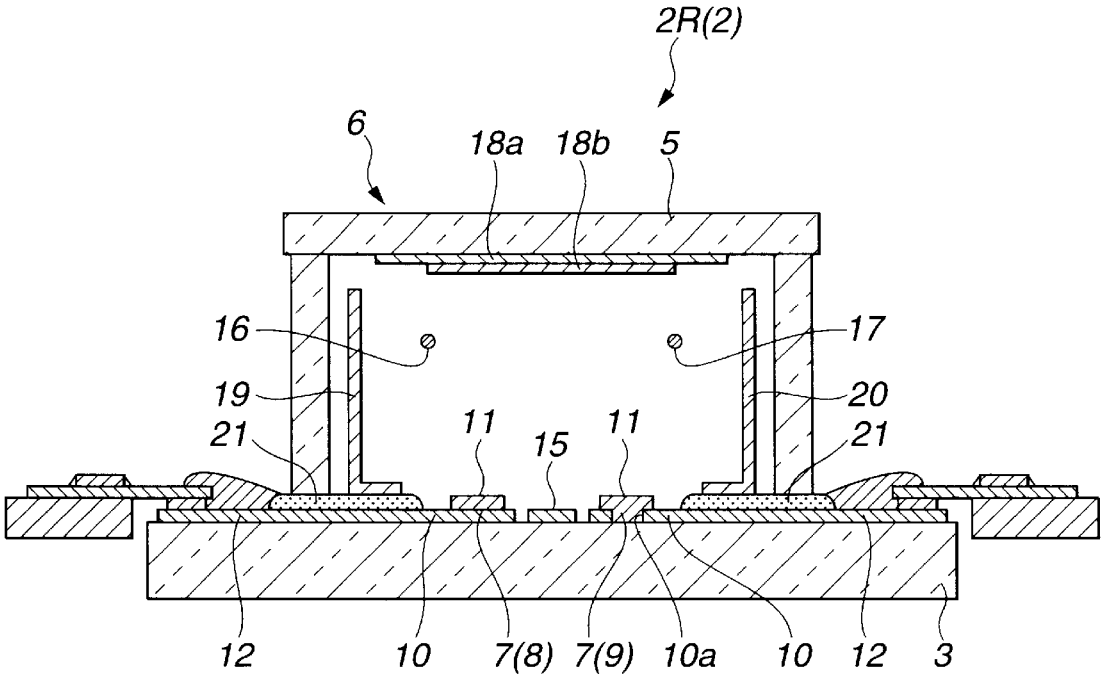
FIG. 3 is a cross-sectional view partially illustrating a fluorescent print head mounted on an optical printer acting as an image forming apparatus.
Figure 4:
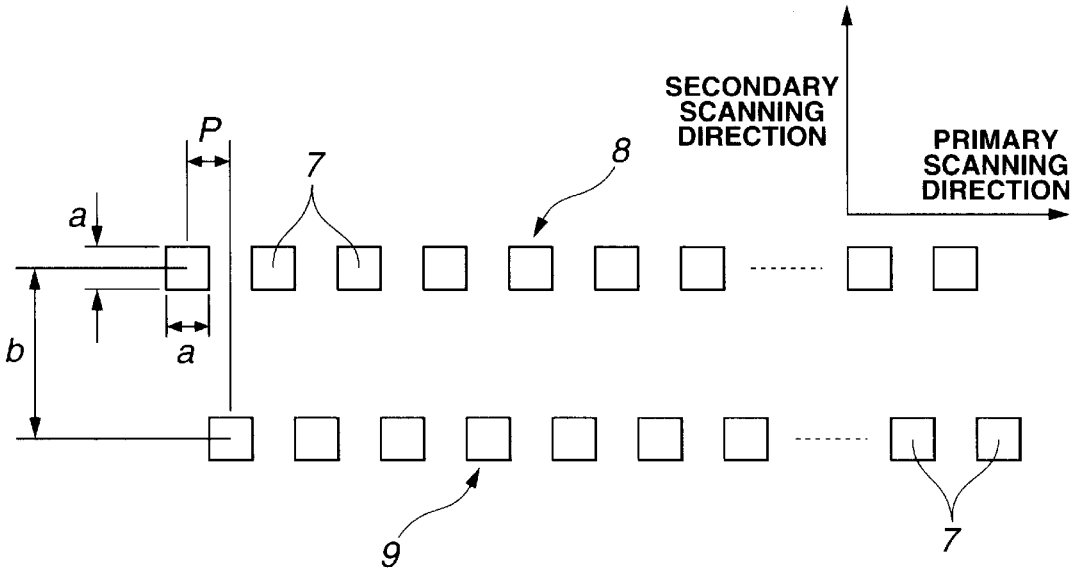
FIG. 4 is a plan view illustrating luminous dots of the fluorescent print head of FIG. 3.
Figure 5A:
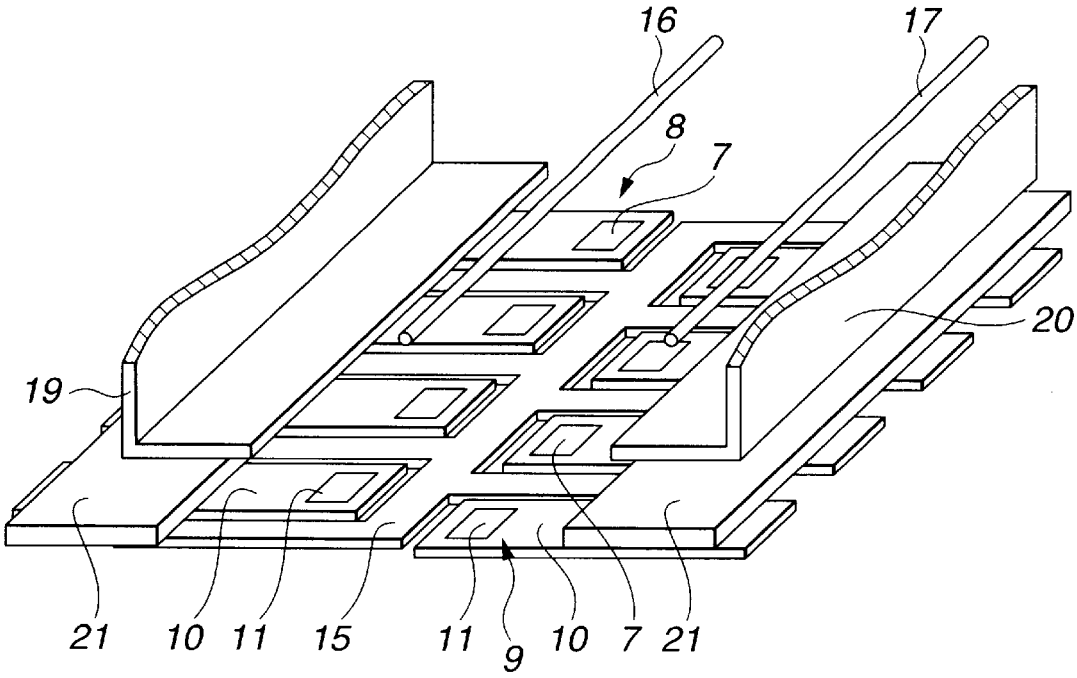
FIG. 5(*a*) is a perspective view partially illustrating the anode substrate of the fluorescent print head of FIG. 3 and FIG. 5(*b*) is a plan view partially illustrating an anode electrode.
Figure 5B:
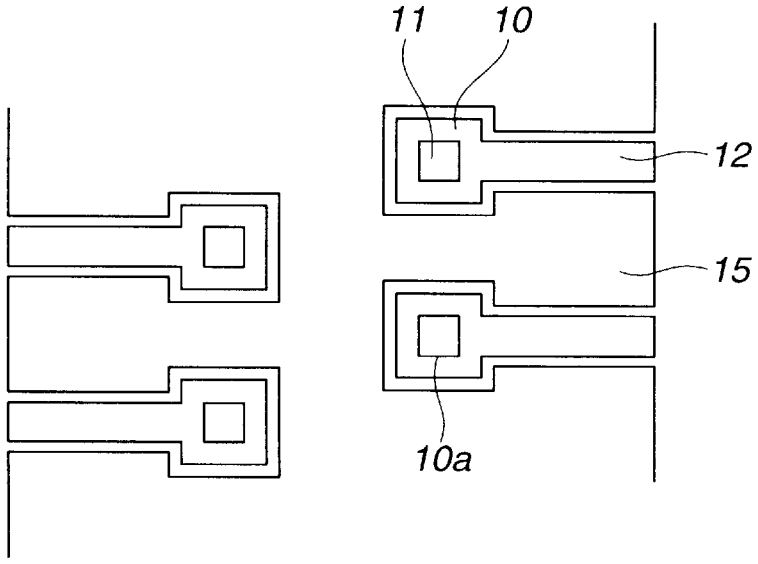

The image forming apparatus in this embodiment, which includes plural fluorescent print heads, is used to an optical printer such as a color printer (for example, with the structure shown in FIG. 6) that forms images on a recording medium (such as a photosensitive film or photographic paper). Each fluorescent print head has the same configuration as that shown in FIGS. 3, 5 and 6. Like numerals are attached to the same elements as those shown in FIGS. 3, 5 and 6. Hence, the duplicate explanation will be omitted here.

When the optical printer 1, on which fluorescent print heads 2 are mounted, forms an image on a recording medium (film 25), the light amount necessary for light-exposing the recording medium is fixed. In the anode/grid voltage conditions at the time of printing, an anode voltage (Eb)=20 to 60 volts and grid voltage (Ec)=40 to 60 volts, preferably, Eb≦Ec.

The operational lifetime of the fluorescent print head 2 depends on the filament temperature, as pointed out with the conventional problems. It is necessary to prolong the operational lifetime by decreasing the filament temperature.

Figure 10:
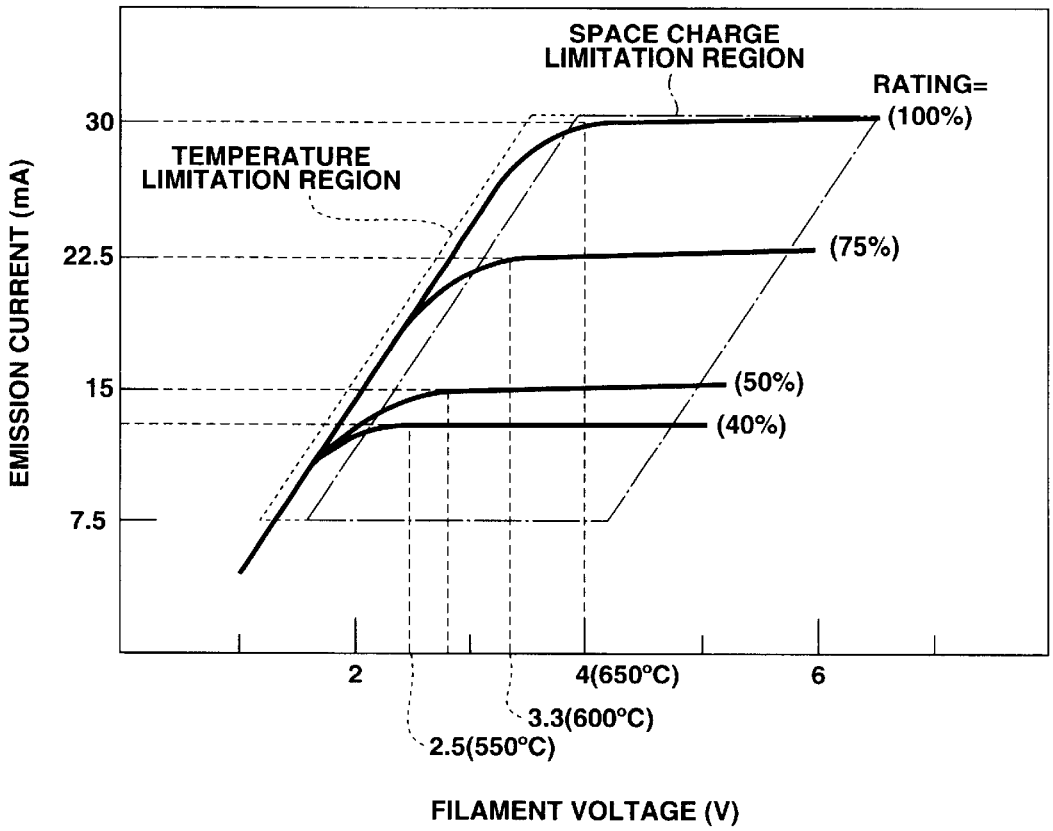
FIG. 10 is a diagram illustrating the relationship between filament voltages and emission current (Ik).

As shown in FIG. 10, the lower limit of the filament temperature in a space charge area depends on Ik (emission current). For that reason, the drive circuit 31 for a fluorescent print head 2 mounted on the image forming apparatus (the optical printer 1) decreases the emission current Ik, thus decreasing the filament voltage Ef to drop the filament temperature.

That is, the drive circuit 31 decreases the drive voltage as much as possible with the timing of no actual contribution to printing, that is, with the timing of no light emission, thus decreasing the average current. Thus, the operational lifetime of the fluorescent print head is improved by alleviating the load (Ik: lowered emission current) to the filament cathode 16, 17, thus lowering the filament temperature.

Conventionally, because pre-light emission is performed by drive operation under the same conditions as those for the print light emission, the pre-light emission causes further reduction of the operational lifetime. For the countermeasures, the drive circuit 31 further alleviates the load on the filament cathode 16, 17 in pre-light emission mode, compared with the light emission mode during printing, to decrease the filament temperature.

In this embodiment, as shown in FIG. 2(*a*), the drive circuit 31 controllably drives various electrodes (anodes 10, a flat control electrode 15, and filament cathodes 16 and 17) with the timings shown in FIGS. 2(*b*) to 2(*e*). Each timing, as shown in FIG. 2(*a*), has three periods including (1) the pre-luminous period T1 during which luminous dots 7 glow before an image is formed on a recording medium, (2) the print luminous period T2 during which luminous dots 7 glow when an image is formed on a recording medium, and (3) the non-luminous period T3 during which luminous dots 7 are lit off to form no image on a recording medium.

Figure 6:
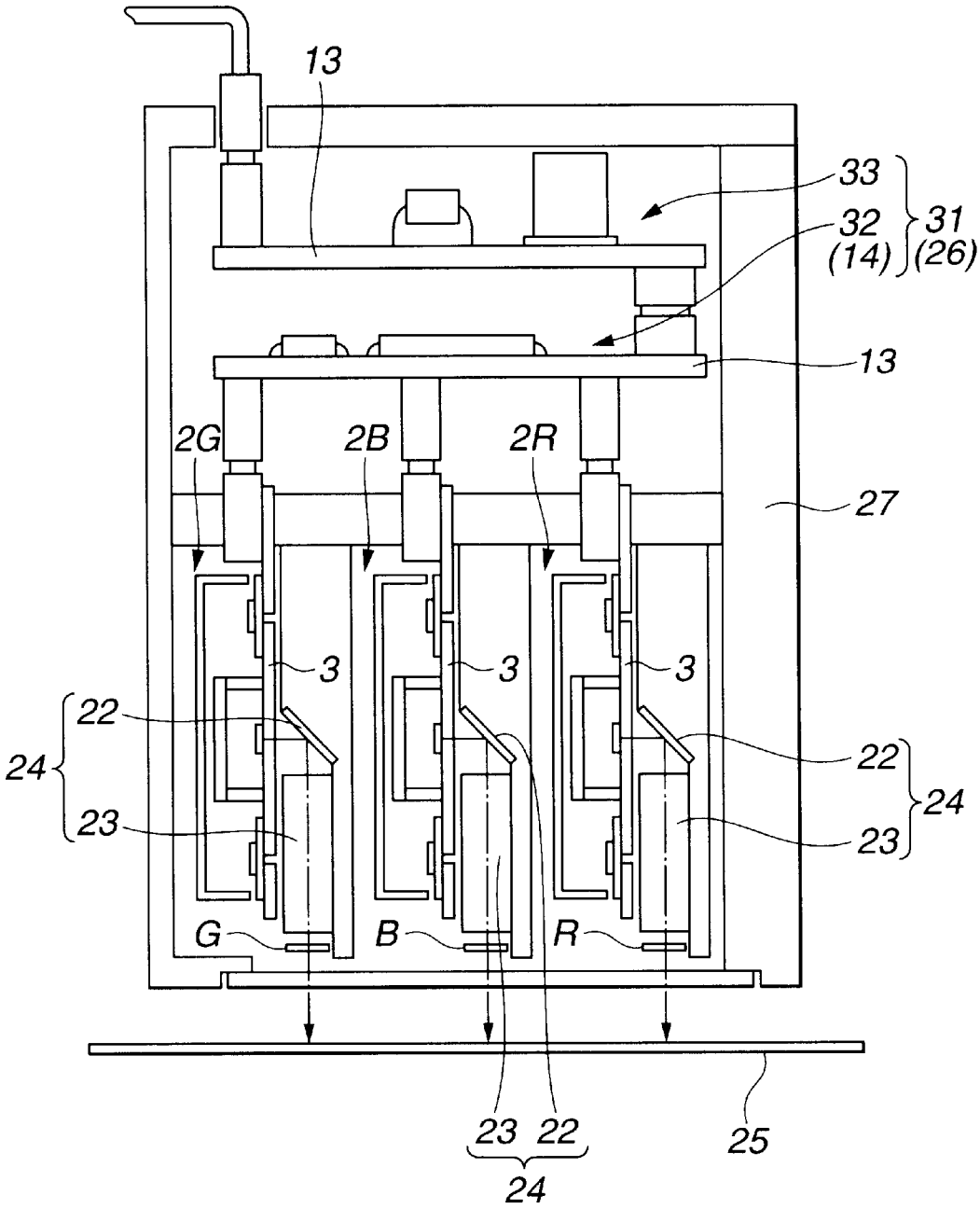
FIG. 6 is a side view illustrating an optical printer including three print heads respectively for a R (red) luminous color, a G (green) luminous color, and a B (blue) luminous color.
Figure 7:
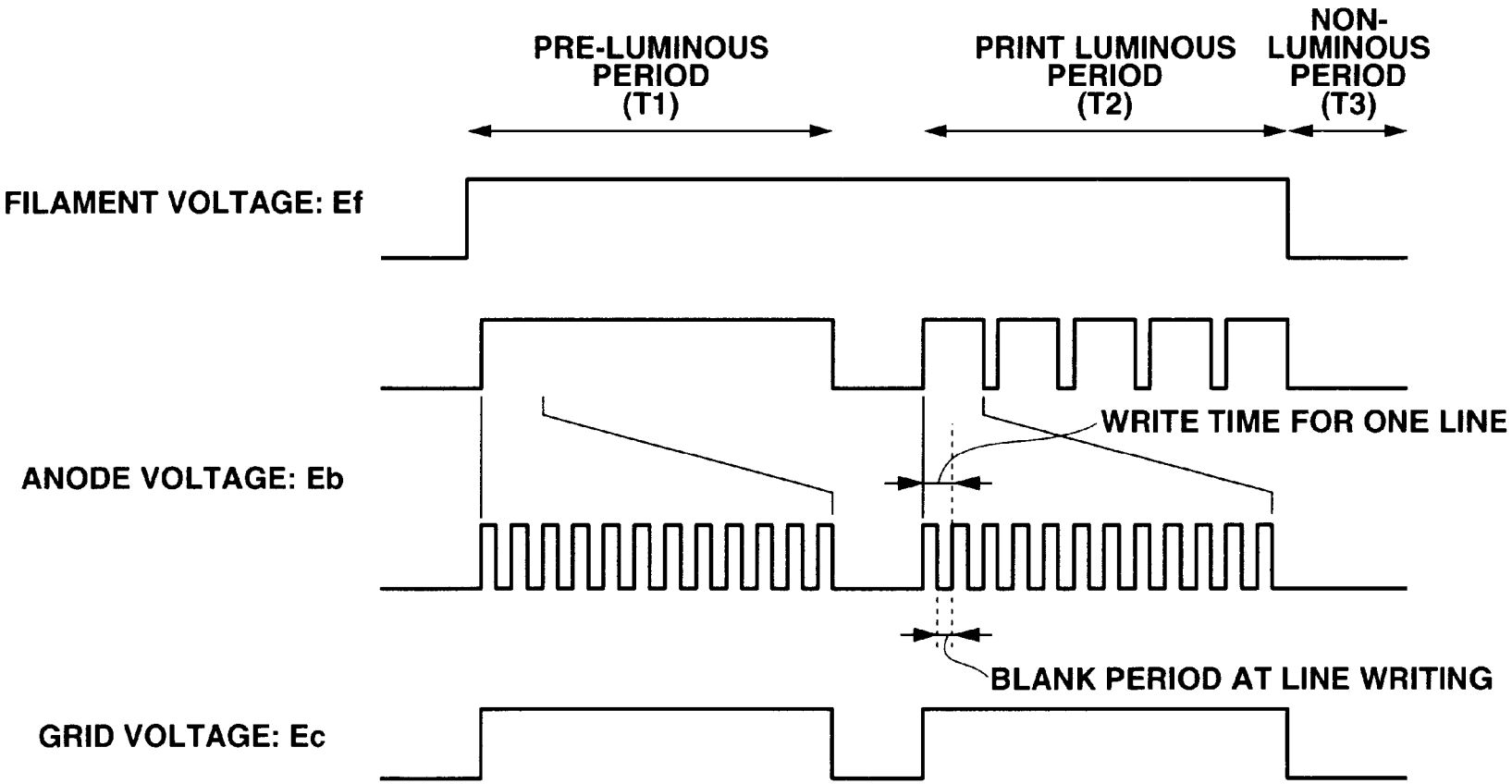
FIG. 7 illustrates a timing chart of a drive circuit for a conventional fluorescent print head.
Figure 8:
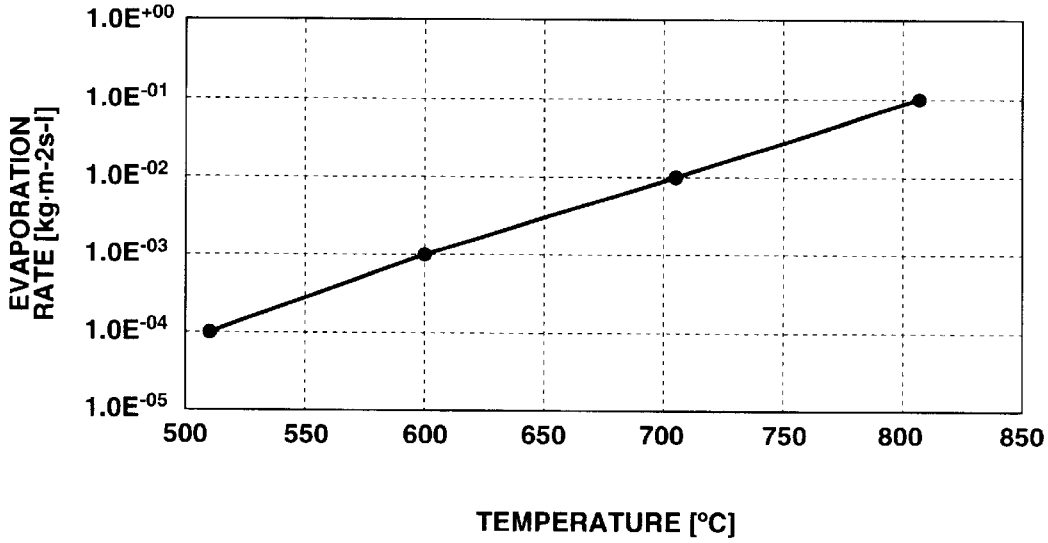
FIGS. 8 is a diagram illustrating the relationship between filament temperature and Ba evaporation rate.

As shown in FIG. 6, the drive circuit 31 includes the control circuit 32 and the power source circuit 32, mounted on the circuit substrate 13 inside a modulalized housing 27.

As shown in FIG. 1, the control circuit 32 consists of a signal processor 32*a* and a controller (CPU) 35. The power source circuit 33 includes a voltage selector 33*a*. The drive circuit 31 controllably drives the anodes 10, the flat control electrode 15, and the filament cathodes 16 and 17 during three periods T1, T2 and T3.

Moreover, as shown in FIG. 1, the body of the optical printer 1 has a circuit substrate on which a system controller (CPU) 34, a controller (CPU) 35, and an image memory 36 are mounted. A motor drive circuit 37 and a stepping motor 38 are mounted on the printer 1 to relatively move the fluorescent print head 2 and the recording medium 25 during printing.

The system controller 34 comprehensively controls various portions for print operation and inputs a pre-luminous signal, a print starting signal and color image data to the controller 35. The system controller 34 also outputs a control signal to the motor drive circuit 37 to control the rotation and halt of the stepping motor 38 when the fluorescent print head 38 and the recording medium 25 are relatively moved.

When a pre-luminous signal is input from the system controller 34, the controller 35 captures pre-luminous pattern data (pre-luminous drive data) from the image memory 36 and then outputs it to the signal processor 32*a*.

When a print starting signal is input from the system controller 34, the controller 35 captures color image data (print drive data) from the system controller 34 and then outputs it as image data for each three primary colors (R, G, B) to the signal processor. At the same time, the controller 35 captures data regarding power source drive conditions from the image memory 36 and outputs a voltage switching signal to the voltage selector 33*a* according to the captured data.

The image memory 36 stores data regarding power source drive conditions (such as voltage) and luminous pattern conditions (such as light emission in thick pattern).

The signal processor 32*a* outputs a control signal to the driver 32*b* based on pre-luminous pattern data or image data input from the controller 35.

The driver 32*b* is electrically connected to the fluorescent print heads 2R, 2G, and 2B, each which performs light exposure in terms of a corresponding primary color. The driver 32*b* outputs a drive control signal to the anode 10 corresponding to the fluorescent print head R, G or B in accordance with the three periods T1, T2 and T3, based on the control signal from the signal processor 32*a*.

The voltage selector 33*a* selects drive voltages for the filament cathodes 16 and 17 and the anodes 10 (and the flat control electrodes 15) of the fluorescent print head 2, based on the voltage switching signal input from the controller 35.

The voltage selector 33*a* also may include plural power sources (not shown), each which generates a different drive voltage, and a selector circuit (not shown) that selects a power source that generates a drive voltage corresponding to a voltage switching signal input from the controller 35. The voltage selector 33*a* may be a variable power source that generates a drive voltage corresponding to a voltage switching signal input from the controller 35.

Referring to FIG. 1, a combination of the controller 35 mounted on the body of the optical printer 1 and the signal processor 32*a* mounted on the fluorescent print head 2 corresponds to the controller (CPU) defined in claims. The controller 35 and the signal processor 32*a* can be integrated as one controller (CPU). In such a case, the controller may be arbitrarily mounted on the body of the optical printer or on the fluorescent print head 2.

In the configuration of FIG. 1, an additional memory may store data on power source conditions and data on luminous pattern conditions, without storing in the image memory 36. Thus, the system controller 34 reads the stored data and then outputs it to the controller 35. Moreover, the image memory 36 may be mounted on the fluorescent print head 2. Thus, the controller 35 reads data stored in the image memory 36.

Next, various operations of the control circuit 32 in the drive circuit 31 during the pre-luminous period T1, the print luminous period T2, and the non-luminous period T3 will be described here. In the following explanation, the rated condition during the pre-luminous period T1 is defined as the drive condition (drive voltage) for the print luminous period T2 during which the luminous dot 7 glows when an image is formed on a recording medium (film 25). Moreover, the rated condition during the print luminous period T2 is defined as a filament voltage applied to a filament cathode when the anode voltage and the grid voltage are not controlled with the duty ratio corresponding to the blank period (1) Pre-luminous Period In the pre-luminous period T1, at least one of the anode voltage Eb applied to the anode 10 and the grid voltage Ec applied to the flat control electrode 15 is adjusted to a predetermined voltage lower than the rated condition to drive the anode 10 and the flat control electrode 15.

In FIG. 2, the grid voltage Ec is controlled to a predetermined voltage lower than the rated condition. However, the anode voltage Eb may be controlled by a predetermined voltage lower than the rated condition. This can alleviate the load on the filament cathode 16, 17, thus reducing the average current (Ik). Thus, the filament temperature can be lowered by controlling the filament voltage Ef to a predetermined voltage lower than a rated condition and heating and driving the filament 16, 17. As a result, the evaporation amount of Ba on the filament cathode 16, 17 is decreased. Thus, deterioration of the luminous efficiency is suppressed and the operational lifetime can be prolonged.

In another drive operation during the pre-luminous period T1, the anode voltage applied to the anode 10 and/or the grid voltage applied to the flat control voltage 15 are set to a predetermined duty ratio, as shown in FIG. 2(*e*). The anode 10 and/or the flat control electrode 15 are driven in time-divisional mode to blink luminous dots 7. By doing so, the load on the filament cathode 16, 17 is alleviated so that the average current (Ik) can be decreased. Moreover, the filament temperature can be decreased by controlling the filament cathode Ef to a predetermined voltage lower than the rated condition and then heating and driving the filament cathode 16, 17. As a result, the evaporation amount of Ba on the filament cathode 16, 17 decreases and a variation of light amount in the pre-luminous mode is alleviated. Finally, suppressed deterioration of the luminous efficiency contributes to an improved serviceable lifetime.

The anode voltage and the grid voltage are set to the same predetermined duty ratio and the anode 10 and the flat control electrode 15 are synchronously driven in time-divisional mode.

The above-mentioned driving methods can be combined together (not shown). Specifically, the anode voltage and/or the grid voltage are set to a predetermined voltage lower than the rated condition and to a predetermined duty ratio. The anode 10 and/or the flat control electrode 15 are driven in time-divisional mode. This driving method can more alleviate the load on the filament cathode 16, 17, thus decreasing the average current (Ik). As a result, the luminous efficiency is further suppressed so that the operational lifetime can be prolonged.

Even when the anode voltage, the grid voltage, or both is decreased during the pre-luminous period T1, the above-mentioned effects can be obtained by uniformly impinging thermal electrons against a fluorescent substance and removing the residual gas on the surface of the fluorescent substance. However, since the pre-light emission is performed to remove gas adhered to a fluorescent substance and to stabilize the light emission (light amount), a higher anode voltage is better to the gas adhered to the fluorescent substance. A drive operation by a decreased grid voltage, not a decreased anode voltage, is effective to alleviate the filament load, without decreasing the gas removing effect.

For example, when a center-tapped filament is driven, the emission current (Ik) flows to both ends of the filament. For that reason, the temperature of both the ends of the filament rises the superimposed emission current by the Joule heat. The local temperature rise deteriorates the uniformity of the filament temperature in the longitudinal direction (or in the primary scanning direction) (this is applicable to a DC drive operation of a filament). The temperature change leads to a different evaporation rate of Ba in the longitudinal direction of a filament, thus resulting in variations of the operational lifetime. Hence, in order to improve the operational lifetime, it is necessary to decrease the anode voltage and the grid voltage and to reduce the emission current (Ik). Reducing the emission current (Ik) causes reducing the filament temperature, so that emitted electrons are reduced. Hence, since the filament temperature rises, it is required to decrease the filament temperature.

(2) Print Luminous Period

During the print luminous period T2, the anode voltage and the grid voltage are controlled under rated conditions when the recording medium is printed to drive the anode 10 and the flat control electrode 15. The anode voltage and/or the grid voltage corresponding to the blank period t between light emission and light emission in a write mode for each line of each recording medium is controlled to a voltage lower than the rated condition.

FIG. 2 is shows the timing with which five recording media are printed during the print luminous period T2. Particularly, when a line light source (a linear light source) is used, the anode voltage applied to the anode 10 between light emission and light emission in the write mode for each line of a recording medium has periodic blank periods. The grid voltage corresponding to the periodic blank period is controlled to be less than a rated voltage. Compared with the conventional method, that operation can alleviate the load on the filament 16, 17 so as to decrease the total average current (Ik). Moreover, the filament temperature can be decreased by controlling the filament voltage Ef to a predetermined voltage lower than a rated condition and heating and driving the filament 16, 17. As a result, the reduced temperature reduces the evaporation amount of Ba on the filament 16, 17 and suppresses deterioration of the luminous efficiency, thus resulting in an improved operational lifetime. Since the blank periods of the anode voltage and the grid voltage are very short, the filament temperature is not recognized as a temperature change but appears as a change of the total average emission current (Ik).

Actually, the anode voltage has blank periods which are formed with an image signal. Since the pulse width gradation control (PWM) is performed, the period (blank period) during which the anode voltage becomes off exists so long as the image signal is not in full gradation. That is, when an image is output, the average gradation component of the image undergoes an apparent Du (duty) drive operation so that the total average emission current (Ik) drops.

In further explanation, when a linear light source is used, the light amount is controlled with the pulse width during one-line write period. This light amount control includes the correction control of light amount variation and the light amount control in accordance with the gradation number of image data, and the correction control of individual difference of a photosensitive amount and provides non-luminous blank periods.

It is now assumed that the variation control results in a 20% light-amount drop at both the ends of a filament and that the minimum value correction results in a luminous time of 90% (Max 80%) on average and that the individual difference correction of each fluorescent print head results in 70% (Max 60%) on average. In such a case, even when the input data is a full gradation of 1024, an average of 40% of a blank period occurs.

(3) Non-luminous Period

During the non-luminous period T3, the anode voltage and the grid voltage are controlled to be 0 volts. Since current does not flow through the anode 10 and the flat control electrode 15, the filament voltage is controlled to be 0 volts. This allows the filament temperature to be reduced.

During the pre-luminous period T1 and the print luminous period T2, the drive circuit 31 in the fluorescent print head 2 controls the anode voltage and/or the grid voltage and drops the filament voltage, at the time of light emitting luminous dots 7 except the time of printing an image onto a recording medium (film 25). Thus, the evaporation amount of Ba contained in an electron emission material on the filament cathode 16, 17 can be reduced. This can suppress deterioration of the luminous efficiency and reduce the consumption energy and improve the serviceable lifetime of a fluorescent print head. Moreover, the alleviation of dimming due to lowered temperatures and the alleviation of changes in light amount due to pre-light emission allow the light amount to be stabilized.

During the pre-luminous period T1, because it is desirable to remove gas on adhered to a fluorescent substance, the drive voltage may be lower than the drive voltage during the print luminous period T2. In other words, because it is not required to impose the load on the filament during the pre-luminous period T1, the filament voltage can be set at a low value.

Table 1 shows comparisons between numerals in drive operations under conventional rated conditions and numerals in drive operations (during the pre-luminous period T1 and the print luminous period T2) according to the present invention.

TABLE 1

Figure 9:
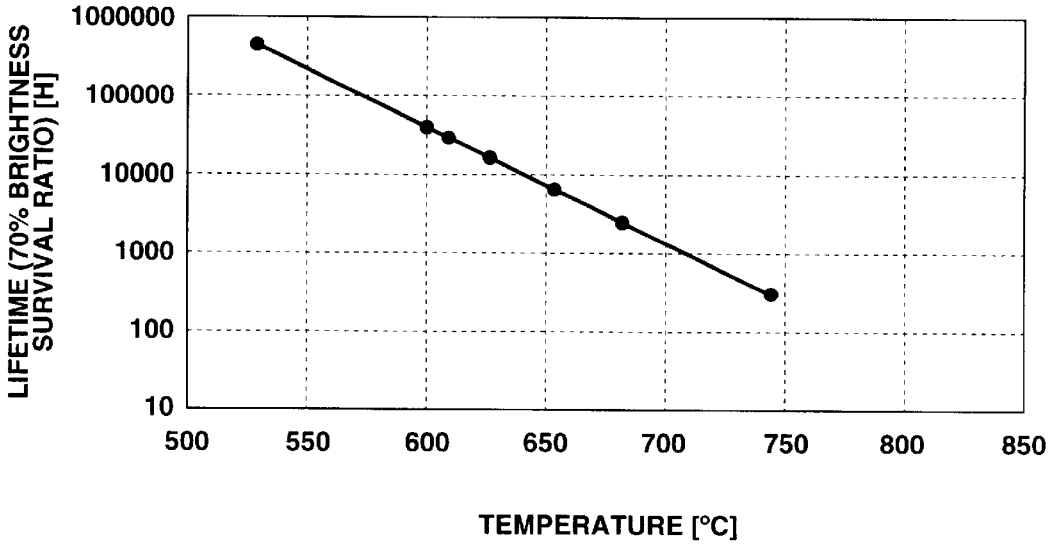
FIG. 9 is illustrating the relationships between filament temperature and operational life.

| | Rated Condition (prior art) | Invention (pre-luminous period: T1) | Invention (print luminous period: T2) |
|---|---|---|---|
| Filament Voltage Ef | 4.0 V (If = 100 mA) | Ef = 2.5 V | Ef = 3.3 V (If = 88 mA) |
| Grid voltage Ec | 40 V Ic = 20 mA | 20 V Ic = 6 mA | 40 V Ic = 16 mA |
| Anode voltage Eb | 40 V Ib = 10 mA | 40 V Ib = 6.3 mA | 40 V Ib = 7 mA |
| Ik | (Ib + Ic)Ik = 30 mA | 12.3 mA | 23 mA |
| Temperature (refer to FIG. 10) | Rating (100%) Filament temperature about 650° C. | (about 40%) about 550° C. | (about 75%) about 600° C. |
| Lifetime (refer to FIG. 9) | $1.0E^3$ to $1.0E^4$ | $1.0E^5$ to $1.0E^6$ | $1.0E^4$ to $1.0E^5$ |

In FIG. 1, the grid voltage is driven with a voltage lower than the rated condition during the pre-luminous period T1 of the present invention. A blank period of a grid voltage to be applied to the flat control electrode 15 is provided during the print luminous period T2. The grid voltage blank period corresponds to the blank period between light emission and light emission at the time when an anode voltage applied to the anode 10 is written for one line on the recording medium 25. The anode average current value and the grid average current value are set at lower value than the value under the rated condition (an average drive current value at rating).

As understood from Table 1, according to the present invention, the filament can be driven at a lowered filament temperature, compared with the driving operation under the conventional rated conditions. The evaluation of Ba containing the electron emission material on a filament cathode can be reduced. Compared with the drive operation under the conventional rated conditions, the operational lifetime can be improved by one digit.

In this embodiment, the fluorescent print head 2 including a grid electrode (the flat control electrode 15) for controlling electrons emitted from the filament cathode 16, 17 or uniformly maintaining the electric field has been explained as an example. However, the configuration with no grid electrodes may be employed for the configuration and the driving method in the present embodiment.

As apparent from the above explanation, the present invention can suppress deterioration of the luminous efficiency of a fluorescent substance, reduce the consumption energy, and improve the operational lifetime of a fluorescent print head. Moreover, the alleviation of dimming due to lowered temperatures and the alleviation of changes in light amount due to pre-light emission allow the light amount to be stabilized.

What is claimed is:

1. A method of driving a fluorescent print head, said fluorescent print head having a filament cathode, a control electrode for controlling electrons emitted from said filament cathode, a fluorescent substance layer having a plurality of luminous dots each which emits light when electrons emitted from said filament cathode impinges against said fluorescent substance layer, and an anode on which said fluorescent substance layer is coated, wherein a pre-luminous period during which said luminous dots glow before an image is formed on a recording medium and a print luminous period during which said luminous dots glow to create an image on said recording medium are provided, said method comprising the steps of:

during said pre-luminous period, controlling at least one of an anode voltage to be applied to said anode and a grid voltage to be applied to said control electrode, to a rated voltage or less in a print luminous mode; and controlling a filament voltage to be applied to said filament cathode to a rated voltage or less in a print luminous mode.

2. A method of driving a fluorescent print head, said fluorescent print head having a filament cathode, a control electrode for controlling electrons emitted from said filament cathode, a fluorescent substance layer having a plurality of luminous dots each which emits light when electrons emitted from said filament cathode impinges against said fluorescent substance layer, and an anode on which said fluorescent substance layer is coated, wherein a pre-luminous period during which said luminous dots glow before an image is formed on a recording medium and a print luminous period during which said luminous dots glow to create an image on said recording medium are provided, said method comprising the steps of:

during said pre-luminous period, controlling an anode voltage to be applied to said anode or a grid voltage to be applied to said control electrode, with a predetermined duty ratio; and controlling a filament voltage to be applied to said filament cathode to a rated voltage or less in a print luminous mode.

3. A method of driving a fluorescent print head, said fluorescent print head having a filament cathode, a control electrode for controlling electrons emitted from said filament cathode, a fluorescent substance layer having a plurality of luminous dots each which emits light when electrons emitted from said filament cathode impinges against said fluorescent substance layer, and an anode on which said fluorescent substance layer is coated, wherein a pre-luminous period during which said luminous dots glow before an image is formed on a recording medium and a print luminous period during which said luminous dots glow to create an image on said recording medium are provided, said method comprising the steps of:

controlling an anode voltage to be applied to said anode or a grid voltage to be applied to said control electrode, to a rated voltage or less in a print luminous mode;

controlling said anode voltage or said grid voltage with a predetermined duty ratio; and controlling a filament voltage applied to said filament cathode to a rated voltage or less in a print luminous mode.

4. A method of driving a fluorescent print head, said fluorescent print head having a filament cathode, a control electrode for controlling electrons emitted from said filament cathode, a fluorescent substance layer having a plurality of luminous dots each which emits light when electrons emitted from said filament cathode impinges against said fluorescent substance layer, and an anode on which said fluorescent substance layer is coated, wherein a blank period of a grid voltage applied to said control electrode corresponding to the blank period between glow states during which an anode voltage to be applied to said anode is written for each line of a recording medium is provided, said method comprising the steps of:

during a print luminous period for which said luminous dots glow when an image is created on said recording medium, controlling said anode voltage and said grid voltage, to a rated voltage in a print luminous mode with a duty ratio corresponding to said blank period; and controlling a filament voltage to be applied to said filament cathode to a rated voltage or less in a print luminous mode.

5. The method defined in any one of claims 1 to 3, further comprising the steps of:

providing a blank period of said grid voltage corresponding to a blank period between glow states during which an anode voltage to be applied to said anode is written for each line of said recording medium;

during a print luminous period for which said luminous dots glow when an image is created on said recording medium, controlling said anode voltage and said grid voltage to a rated voltage in a print luminous mode with a duty ratio corresponding to said blank period; and controlling said filament voltage to a rated voltage or less in a print luminous mode.

6. A method of driving a fluorescent print head, said fluorescent print head having a filament cathode, a fluorescent substance layer having a plurality of luminous dots each which emits light when electrons emitted from said filament cathode impinges against said fluorescent substance layer, and an anode on which said fluorescent substance layer is coated, wherein a pre-luminous period during which said luminous dots glow before an image is formed on a recording medium and a print luminous period during which said luminous dots glow to create an image on said recording medium are provided, said method comprising the steps of:

controlling an anode voltage to be applied to said anode to a rated voltage or less in a print luminous mode; and controlling a filament voltage to be applied to said filament cathode to a rated voltage or less in a print luminous mode.

7. A method of driving a fluorescent print head, said fluorescent print head having a filament cathode, a fluorescent substance layer having a plurality of luminous dots each which emits light when electrons emitted from said filament cathode impinges against said fluorescent substance layer, and an anode on which said fluorescent substance layer is coated, wherein a pre-luminous period during which said luminous dots glow before an image is formed on a recording medium and a print luminous period during which said luminous dots glow to create an image on said recording medium are provided, said method comprising the steps of:

controlling an anode voltage to be applied to said anode with a predetermined duty ratio; and controlling a filament voltage to be applied to said filament cathode to a rated voltage or less in a print luminous mode.

8. An image forming apparatus comprising:

a fluorescent print head having a filament cathode, a fluorescent substance layer having a plurality of luminous dots each emitting light when electrons emitted from said filament cathode impinges against said fluorescent substance layer, and an anode on which said fluorescent substance layer is coated;

a controller for acquiring and outputting pre-luminous pattern data based on a pre-luminous signal and a voltage switching signal and acquiring and outputting image data and a voltage switching signal based on a print starting signal;

a voltage selector for selecting said filament cathode drive voltage and said anode drive voltage to said fluorescent print head based on a voltage switching signal input from said controller; and a driver for driving and emitting said luminous dots of said fluorescent print head based on pre-luminous pattern data or image data input from said controller;

whereby said luminous dots of said fluorescent print head are previously emitted based on a drive voltage input from said voltage selector and pre-luminous pattern data input from said voltage selector;

whereby said luminous dots of said fluorescent print head are emitted based on a drive voltage input from said voltage selector and image data input from said driver and a desired image is created by illuminating light from said luminous dots onto a recording medium.

9. The apparatus defined in claim 8, further comprising a control electrode for controlling electrons emitted from said filament cathode; and wherein said voltage selector selects a drive voltage for said filament cathode, a drive voltage for said anode and a drive voltage for said control electrode of said fluorescent print head based on a voltage switching signal input from said controller.

10. The apparatus defined in claim 8 or 9, wherein said voltage selector comprises plural power sources each for producing a different drive voltage and a selector circuit for selecting a power source which produces a drive voltage corresponding to a voltage switching signal input from said controller.

11. The apparatus defined in claim 8 or 9, wherein said controller acquires and outputs pre-luminous drive data based on a pre-luminous signal and print drive data based on a print starting signal; and wherein said voltage selector includes a variable power source for variably producing a different drive voltage corresponding to a voltage switching signal input from said controller.

* * * * *

UNITED STATES PATENT AND TRADEMARK OFFICE

CERTIFICATE OF CORRECTION

PATENT NO. : 6,664,997 B2
DATED : December 16, 2003
INVENTOR(S) : Shimizu et al.

It is certified that error appears in the above-identified patent and that said Letters Patent is hereby corrected as shown below:

Title page,
Item [30], should read:
-- [30] Foreign Application Priority Data
Apr. 9, 2001 (JP) ……. 2001-110127 --

Signed and Sealed this

Twenty-seventh Day of April, 2004

JON W. DUDAS
*Acting Director of the United States Patent and Trademark Office*